US009618226B2

(12) United States Patent
Chen et al.

(10) Patent No.: US 9,618,226 B2
(45) Date of Patent: Apr. 11, 2017

(54) AIR-CONDITIONING SYSTEM INTEGRATED WITH APP OF SMART PORTABLE DEVICE

(71) Applicant: SHU-TE UNIVERSITY, Kaohsiung (TW)

(72) Inventors: Chih-Yung Chen, Kaohsiung (TW); Jun-Juh Yan, Tainan (TW)

(73) Assignee: SHU-TE University, Kaohsiung (TW)

( * ) Notice: Subject to any disclaimer, the term of this patent is extended or adjusted under 35 U.S.C. 154(b) by 470 days.

(21) Appl. No.: 13/924,933

(22) Filed: Jun. 24, 2013

(65) Prior Publication Data

US 2014/0245765 A1 Sep. 4, 2014

(30) Foreign Application Priority Data

Apr. 3, 2013 (TW) ..... 102112068 A

(51) Int. Cl.
*F24F 11/00* (2006.01)

(52) U.S. Cl.
CPC ... *F24F 11/0086* (2013.01); *F24F 2011/0071* (2013.01)

(58) Field of Classification Search
CPC ..... F24F 11/0086; F24F 2011/0071; F24F 2011/0068; F24F 11/0012; F24F 2011/0067; F24F 11/006; G05D 23/1917
See application file for complete search history.

(56) References Cited

U.S. PATENT DOCUMENTS 4,981,139 A * 1/1991 Pfohl ..... A61B 5/0017 600/484
6,061,576 A * 5/2000 Terrasson ..... H04M 1/72583 455/566
8,280,323 B2 * 10/2012 Thompson ..... H03F 1/02 455/107
2005/0097902 A1 * 5/2005 Kwon ..... F24F 11/0086 62/126
2007/0114295 A1 * 5/2007 Jenkins ..... F24F 11/0012 236/51
2010/0271208 A1 * 10/2010 Steinmetz ..... F16P 3/147 340/572.1
2012/0053739 A1 * 3/2012 Brian ..... G06F 1/3203 700/287

(Continued)

FOREIGN PATENT DOCUMENTS

JP 2010175102 A * 8/2010

*Primary Examiner* — Allana Lewin Bidder
*Assistant Examiner* — Kun Kai Ma

(57) ABSTRACT

An air-conditioning system integrated with an application program (APP) of a smart portable device comprises at least an air-conditioning controller, an APP and a plurality of air-conditioning devices. The air-conditioning controller comprises a temperature sensor, provided for sensing an environment temperature so as to transmit a temperature signal. The APP is installed on a smart portable device such that the APP can transmit an operation signal to the air-conditioning controller according to the temperature signal via the smart portable device. The air-conditioning controller further transmits a control signal to the plurality of air-conditioning devices such that the air-conditioning devices can be operated according to the control signal.

4 Claims, 4 Drawing Sheets

(56) References Cited

U.S. PATENT DOCUMENTS

| | | | | |
|---|---|---|---|---|
| 2012/0198551 | A1* | 8/2012 | Whitney | H04L 63/1491 726/23 |
| 2012/0253521 | A1* | 10/2012 | Storm | G05D 23/1905 700/276 |
| 2013/0110296 | A1* | 5/2013 | Khoo | B60L 11/1825 700/286 |
| 2013/0274946 | A1* | 10/2013 | Schelenz | H02J 3/383 700/297 |
| 2013/0334326 | A1* | 12/2013 | Shan | G08C 17/02 236/51 |
| 2014/0081465 | A1* | 3/2014 | Wang | G05B 13/02 700/276 |

* cited by examiner

AIR-CONDITIONING SYSTEM INTEGRATED WITH APP OF SMART PORTABLE DEVICE

CROSS-REFERENCE TO RELATED APPLICATIONS

This application claims priority under 35 USC §119 to Taiwan Patent Application No. 102112068, filed on Apr. 3, 2013 in the Taiwan Intellectual Property Office (TIPO), the contents of which are herein incorporated by reference in their entirety.

BACKGROUND OF THE INVENTION

Field of the Invention

The present invention generally relates to an air-conditioning system integrated with an APP of a smart portable device, in particular to an air-conditioning control system integrated with a smart portable device and a smart electricity meter.

Description of the Related Art

Air-conditioners, electric fans and heaters are common home appliance used for adjusting temperature. For example, the air-conditioners and electric fans deliver winds and dissipate heat in hot summers, and the heaters generate heat and warm us up in cold winters.

Based on the statistical data provided by Taiwan Power Company, power consumption for household air conditioning is the main expense of the electric fees in summer, and the monthly electric bill in summer is 28.97% higher than that in seasons other than summer. Therefore, the Bureau of Energy, Ministry of Economic Affairs recommends people to purchase air-conditioners with a higher energy efficiency rate (EER) and set the temperature within a range of 26-28° C. to achieve the power saving effect of using electric fans together with the air-conditioner and control the power consumption of the heater to reduce the burden of the increased electric fees.

However, when people use these temperature adjusting equipments, it is usually difficult for people to control the electric power consumption of equipments and set the room temperature at a desired temperature accurately, not to mention to maintain a balance among saving power, lowering electric fees and maintaining a comfortable room temperature.

SUMMARY OF THE INVENTION

Therefore, it is a primary objective of the present invention to overcome the aforementioned problems of the prior art by providing an air-conditioning system integrated with an APP of a smart portable device in accordance with the present invention.

To achieve the foregoing objective, the present invention provides an air-conditioning control system comprising an air-conditioning controller, an application program (APP) and a plurality of air-conditioning devices.

The air-conditioning controller includes a temperature sensor for sensing an environment temperature to transmit a temperature signal.

Wherein, the application program (APP) is installed to a smart portable device for receiving the temperature signal and transmitting an operation signal to the air-conditioning controller according to the temperature signal via the smart portable device. In addition, the air-conditioning controller transmits a first control signal according to the operation signal, wherein the air-conditioning controller transmits the first control signal by an omni-directional infrared technology.

Wherein, the air-conditioning devices receive the first control signal and operate according to the first control signal. The air-conditioning device can be an air-conditioner, an electric fan or a heater.

The air-conditioning controller transmits the temperature signal and receives the operation signal by a Bluetooth, Zigbee, Radio Frequency (RF), Wireless Fidelity (Wi-Fi), Worldwide Interoperability for Microwave Access (Wi-MAX), General Packet Radio Service (GPRS), $3^{rd}$ Generation (3G) telecommunications technology, $3.5^{th}$ Generation (3.5G) telecommunications technology or Long Term Evolution (LTE) technology.

In addition, the air-conditioning control system further comprises a plurality of smart electricity meters respectively and electrically coupled to the air-conditioning devices for uploading an electric power consumption and an electricity consumption history of each air-conditioning device to the Internet, so that the APP can access the electric power consumption and the electricity consumption history of each air-conditioning device via the Internet. In addition, the APP further accesses an electricity price and a contract capacity via the Internet.

Wherein, the APP can transmit a second control signal according to the electricity price through the air-conditioning controller to control the operation mode of each air-conditioning device. The APP integrates the electricity price to control the operation mode of a high power consuming air-conditioning device in order to save the electricity consumption at peak hours.

Wherein, the APP can transmit a third control signal through the air-conditioning controller according to a contract capacity, so that when the electric power consumption of the air-conditioning device exceeds the contract capacity, the APP controls and stops the operation of each air-conditioning device through the air-conditioning controller. By integrating the contract capacity, the APP can monitor and control the electricity consumption of each air-conditioning device to prevent the electric fee from out of budget.

When the environment temperature is deviated from the predetermined temperature set by the APP, the air-conditioning controller controls each air-conditioning device to operate, stop or adjust an operation mode, so as to adjust the environment temperature to a predetermined temperature. Therefore, using the APP of a smart portable device to set the predetermined temperature can control a plurality of air-conditioning devices synchronously to achieve the thermostatic and power-saving effects.

Wherein, the predetermined temperature is corresponsive to different time intervals, and the APP further adjusts the environment temperature within a time interval to the predetermined temperature according to the predetermined temperature in the time interval. Therefore, when we go to sleep, we can set the predetermined temperature for different time periods by using the APP of the smart portable device, so as to achieve the effects of improving our sleeping quality, and avoiding a too-cold or too-hot environment temperature while we are sleeping.

In addition, the APP computes the electricity price, the contract capacity and the environment temperature by a fuzzy logic algorithm and transmits a first control signal, a second control signal and a third control signal through the air-conditioning controller.

In summation, the air-conditioning system integrated with an APP of a smart portable device of the present invention has one or more of the following advantages:

(1) The air-conditioning system integrated with an APP of a smart portable device of the present invention is further integrated with a smart electricity meter by the APP to monitor the electric power consumption and the electricity consumption history of each air-conditioning device easily through the smart portable device.

(2) The air-conditioning system integrated with an APP of a smart portable device of the present invention is further integrated with an electricity price by the APP to control the operation mode of the high power-consuming air-conditioning device, so as to save the electricity consumption at peak hours.

(3) The air-conditioning system integrated with an APP of a smart portable device of the present invention is integrated with a contract capacity by the APP to monitor the electricity consumption of each air-conditioning device, so as to prevent the electric fee from out of budget.

(4) The air-conditioning system integrated with an APP of a smart portable device of the present invention sets a predetermined temperature by the APP of the smart portable device to control a plurality of air-conditioning devices synchronously, so as to achieve the thermostatic and power-saving effects.

(5) The air-conditioning system integrated with an APP of a smart portable device of the present invention sets predetermined temperatures for different time periods of our sleep by the APP of the smart portable device to improve our sleeping quality, so as to prevent a too-cold or too-hot environment temperature during our sleep.

DETAILED DESCRIPTION OF THE PREFERRED EMBODIMENTS

The technical content of the present invention will become apparent by the detailed description of the following embodiments and the illustration of related drawings as follows. It is noteworthy that same numerals are used to represent respective elements in the following preferred embodiments.

Figure 1:
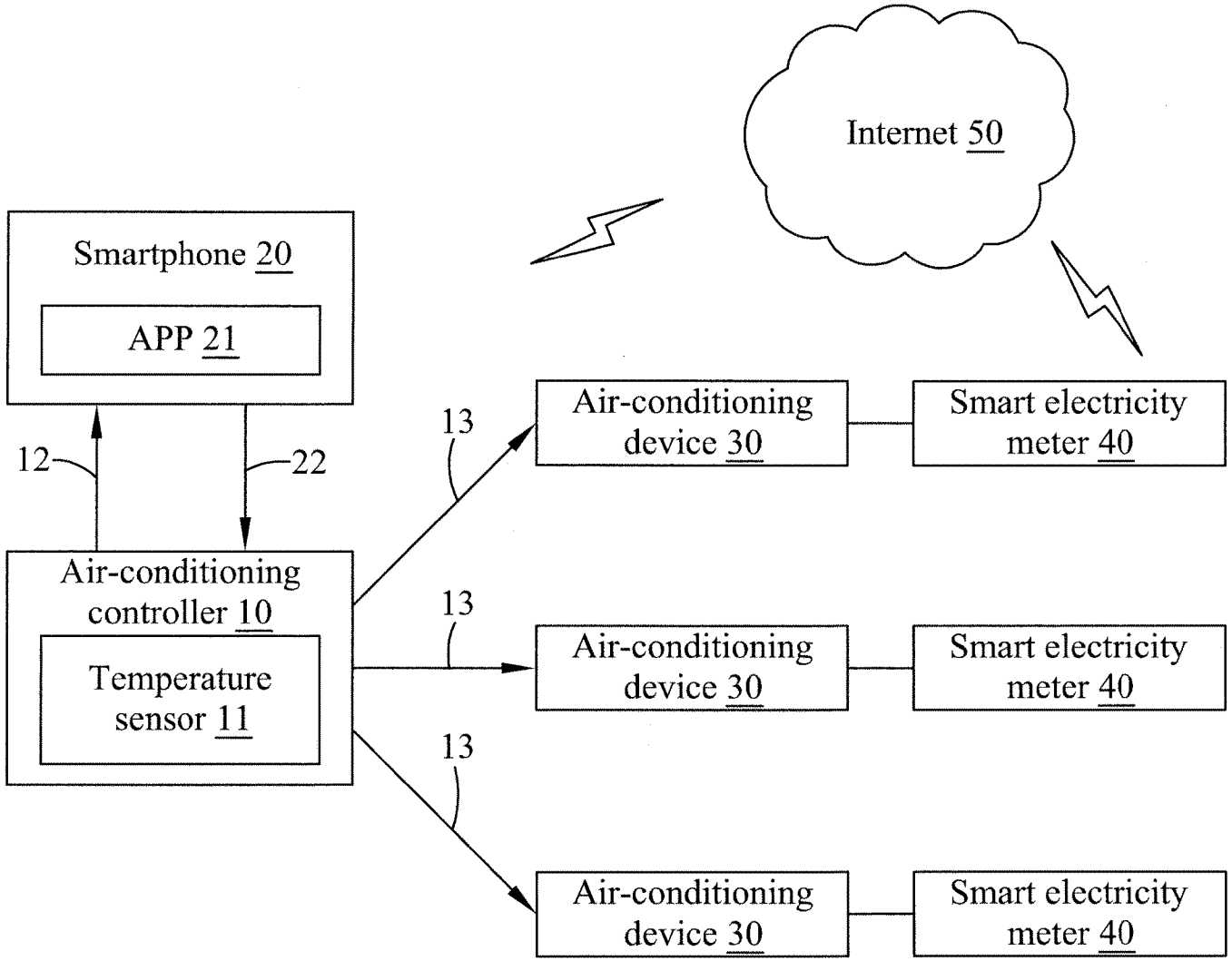
FIG. 1 is a block diagram of an air-conditioning system integrated with an APP of a smart portable device of the present invention.

With reference to FIG. 1 for a block diagram of an air-conditioning system integrated with an APP of a smart portable device in accordance with the present invention, the air-conditioning system comprises an air-conditioning controller 10, an application program (APP) 21 and a plurality of air-conditioning devices 30. Wherein, the air-conditioning device 30 is an air-conditioner, an electric fan or a heater.

The air-conditioning controller 10 includes a temperature sensor 11 for sensing an environment temperature to transmit a temperature signal 12 to the smart portable device with the installed APP 21. Wherein, the smart portable device is a Smartphone 20, a tablet PC, a personal digital assistant (PDA) or a notebook computer.

For the Smartphone 20, the APP 21 receives the temperature signal 12 and transmits an operation signal 22 to the air-conditioning controller 10 according to the temperature signal 12 via the Smartphone 20, and then the air-conditioning controller 10 transits a control signal 13 to the plurality of air-conditioning devices 30 according to the operation signal 22.

The air-conditioning controller 10 transmits the temperature signal 12 and receives the operation signal 22 by a Bluetooth, Zigbee, Radio Frequency (RF), Wireless Fidelity (Wi-Fi), (Worldwide Interoperability for Microwave Access (WiMAX), General Packet Radio Service (GPRS), $3^{rd}$ Generation (3G) telecommunications technology, $3.5^{th}$ Generation (3.5G) telecommunications technology or Long Term Evolution (LTE) technology.

The air-conditioning controller 10 transmits the control signal 13 to the plurality of air-conditioning devices 30 by an omni-directional infrared technology, so that the plurality of air-conditioning devices 30 receive the control signal 13 and operate according to the control signal 13. Wherein, the air-conditioning controller 1 can be an omni-directional infrared controller having a microcontroller chip ATMEGA328P-PU manufactured by Atmel for controlling different branded air-conditioning devices 30.

In addition, the air-conditioning system integrated with an APP of a smart portable device further comprises a plurality of smart electricity meters 40 respectively and electrically coupled to the plurality of air-conditioning devices 30 for uploading the electric power consumption and the electricity consumption history of each air-conditioning device 30 to the Internet 50, so that the APP 21 can access the electric power consumption and the electricity consumption history of each air-conditioning device 30 via the Internet 50. However, the present invention is not limited to such arrangement only, but the air-conditioning control system can also adopts a single smart electricity meter 40 electrically coupled to each air-conditioning device 30.

Wherein, the APP 21 can further access an electricity price and a contract capacity via the Internet 50 to control the electricity consumption of each air-conditioning device 30 automatically.

In addition, the APP 21 fuzzifies the electricity price, the contract capacity and the environment temperature by a fuzzy logic algorithm and uses fuzzy logic rules for a fuzzy inference to generate a fuzzy inference value, and then the fuzzy inference value is defuzzified to generate a control signal 13 through the air-conditioning controller 10 to control the operation mode of the plurality of air-conditioning devices 30. However, the present invention is not limited to such arrangement only, but any computation method capable of controlling the operation mode of the plurality of air-conditioning devices 30 falls within the scope of the present invention.

Figure 2:
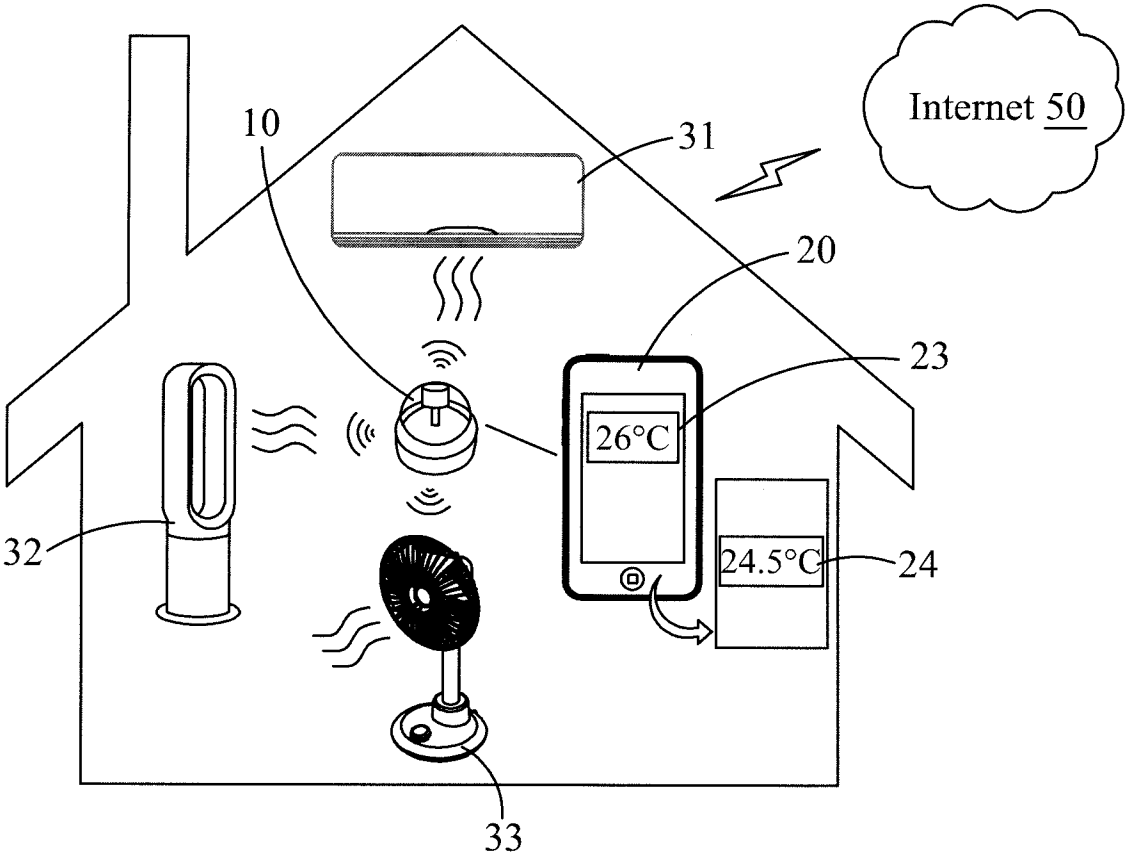
FIG. 2 is a schematic view of an air-conditioning system integrated with an APP of a smart portable device in accordance with a first preferred embodiment of the present invention.

With reference to FIGS. 1 and 2 for a block diagram and schematic views of an air-conditioning system integrated with an APP of a smart portable device in accordance with the first preferred embodiment of the present invention respectively, the APP 21 of the air-conditioning system of the present invention comes with different operation modes capable of controlling the operation mode of each air-conditioning device 30 according to different power-saving strategies.

For example, the APP 21 of the Smartphone 20 can set a predetermined temperature 24, so that the air-conditioning controller 10 can control the operation mode of each air-conditioning device 30 to adjust the environment temperature 23 to the predetermined temperature 24, so that if the environment temperature 23 is deviated from the predetermined temperature 24 set by the APP 21, the air-conditioning controller 10 will operate, stop or adjust the operation mode of the air-conditioner 31, the electric fan 33 or the heater 32, so as to adjust the environment temperature 23 to the predetermined temperature 24. Therefore, the air-conditioner 31, the electric fan 33 or the heater 32 can be controlled synchronously to achieve the thermostatic and power-saving effects.

In addition, the predetermined temperature 24 is corresponsive to different time intervals, and the APP 21 can adjust the environment temperature 23 to the predetermined temperature 24 according to the predetermined temperature 24 of each time interval. For example, the APP 21 of the Smartphone 20 can set a different predetermined temperature 24 for different time periods during our sleep to improve our sleeping quality and prevent a too-cold or too-hot environment temperature 23 during our sleep.

In addition, the APP 21 can adjust the operation mode of each air-conditioning device 30 according to a user's personal preference, and users can turn off all air-conditioning devices 30 by using the APP 21 when they go out, or all air-conditioning devices 30 will be turned off if the signal of the APP 21 of the Smartphone 20 has no response, so as to achieve the power saving effect when there is nobody around.

Figure 3:
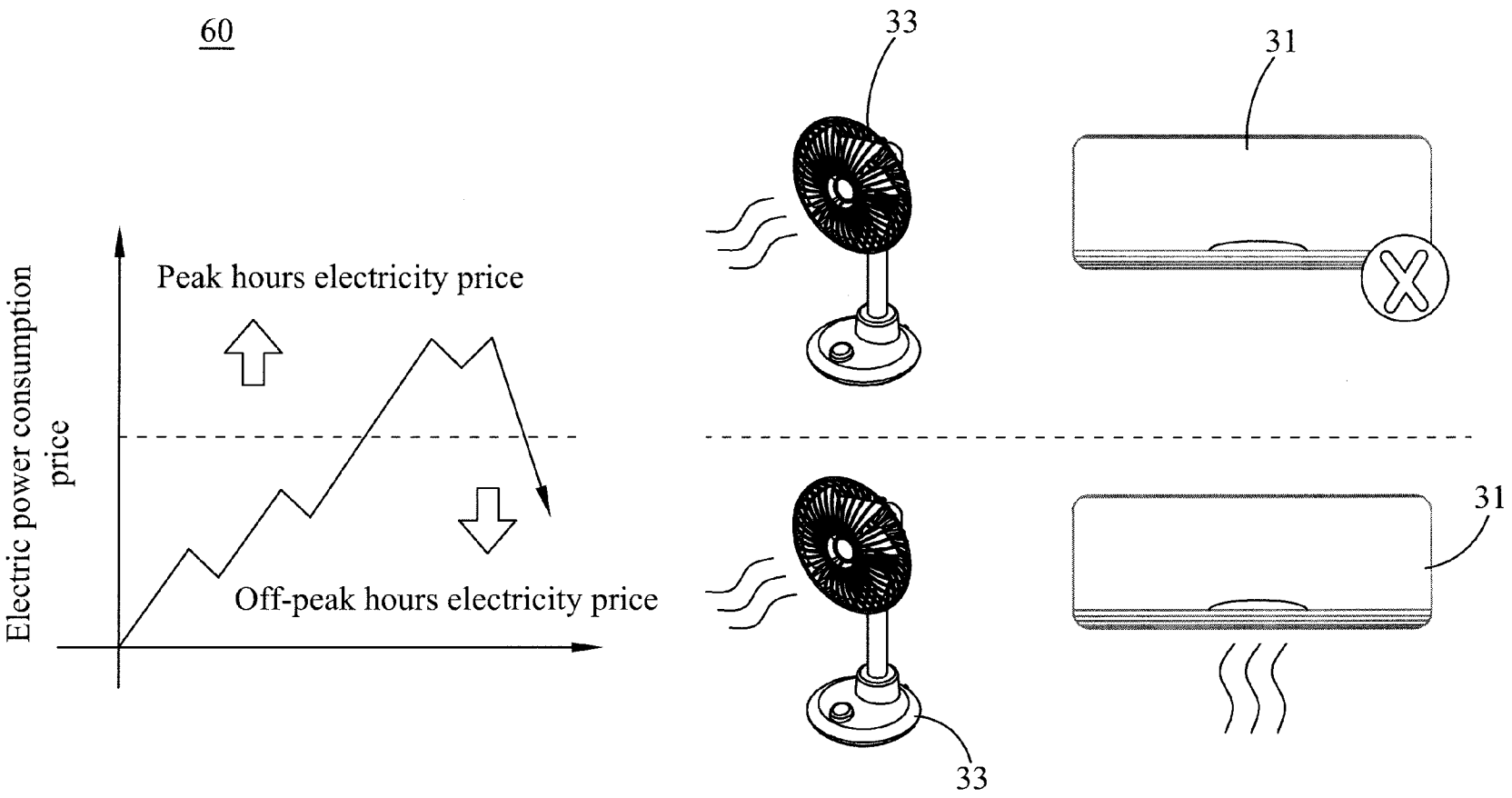
FIG. 3 is a schematic view of an air-conditioning system integrated with an APP of a smart portable device in accordance with a second preferred embodiment of the present invention.

With reference to FIGS. 1 and 3, FIG. 3 shows a schematic view of an air-conditioning system integrated with an APP of a smart portable device in accordance with the second preferred embodiment of the present invention.

The APP 21 accesses an electricity price 60 via the Internet 50 and transmits a control signal 13 through the air-conditioning controller 10 according to the electricity price 60 to control the operation mode of the plurality of air-conditioning devices 30.

For example, the electricity price 60 at peak hours is higher than that at off-peak hours. The APP 21 can transmit a control signal 13 to a high power consuming air-conditioning device 30 such as an air-conditioner 31 through air-conditioning controller 10 to turn off the air-conditioner 31 at the peak hours with a higher electricity price 60 and maintain the electric fan 33 to be turned on to adjust the environment temperature.

On the other hand, the APP 21 can transmit the control signal 13 to the high power consuming air-conditioner 31 through the air-conditioning controller 10 at off-peak hours with a lower electricity price 60, so that the air-conditioner 31 is turned on during the off-peak hours with a lower electricity price 60. Therefore, the APP 21 integrates the electricity price 60 for controlling the operation mode of a high power consuming air-conditioning device 30 to save the electricity consumption at peak hours.

Figure 4:
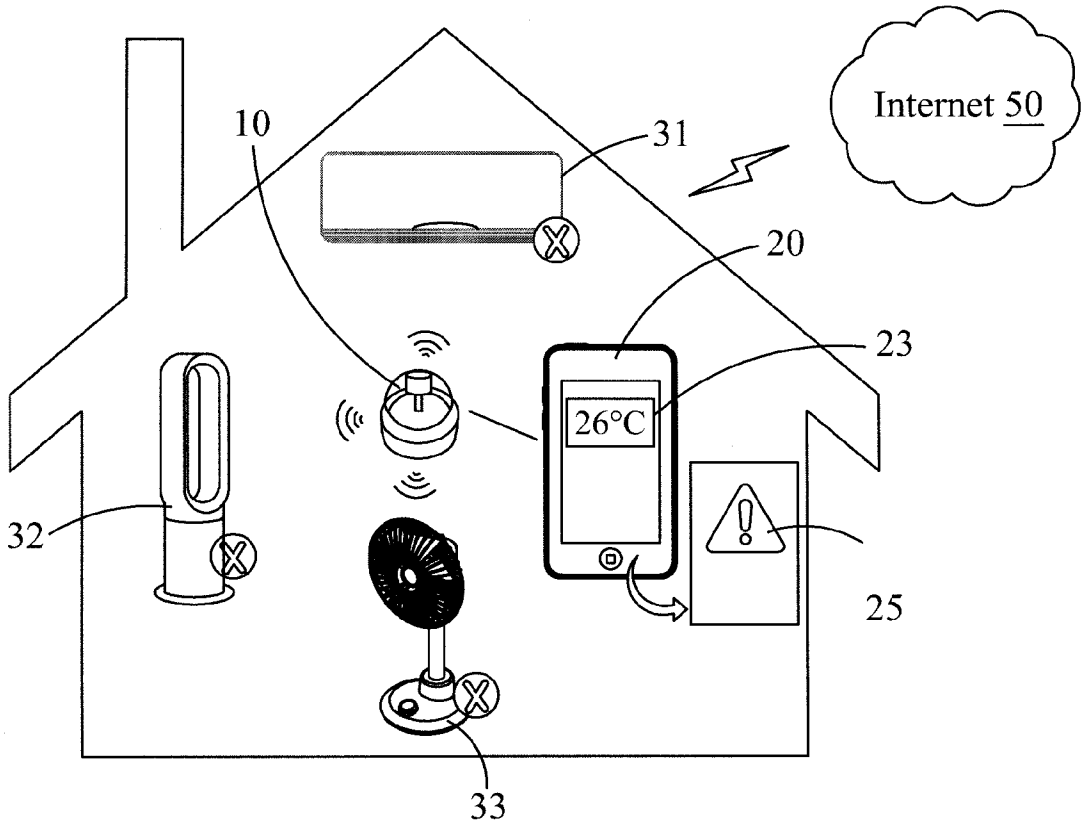
FIG. 4 is a schematic view of an air-conditioning system integrated with an APP of a smart portable device in accordance with a third preferred embodiment of the present invention.

With reference to FIGS. 1 and 4, FIG. 4 shows a schematic view of an air-conditioning system integrated with an APP of a smart portable device in accordance with the third preferred embodiment of the present invention.

The APP 21 further transmits the control signal 13 to each air-conditioning device 30 according to the contract capacity through the air-conditioning controller 10, such that if the electric power consumption of the air-conditioner 31, electric fan 33 and heater 32 is about to exceed, equal to, or has exceeded the contract capacity, the APP 21 will display a warning message 25 while controlling or stopping the operation of the air-conditioner 31, the electric fan 33 and the heater 32 through the air-conditioning controller 10. Therefore, the APP 21 integrates the contract capacity to monitor the electricity consumption of each air-conditioning device 30 to prevent the electric fee from out of budget.

In addition, the APP 21 can set an upper limit of the power consumption of each air-conditioner 31, electric fan 33 and heater 32 to control the electricity consumption of each air-conditioning device 30, so as to achieve the power saving and electric fee saving effects.

While the invention has been described by means of specific embodiments, numerous modifications and variations could be made thereto by those skilled in the art without departing from the scope and spirit of the invention set forth in the claims.

What is claimed is:

1. An air-conditioning system integrated with an application of a smart portable device, comprising:

an air-conditioning controller including a temperature sensor for sensing an environment temperature to transmit a temperature signal;

an application program installed in a smart portable device for receiving the temperature signal and transmitting an operation signal to the air-conditioning controller according to the temperature signal via the smart portable device, and the air-conditioning controller transmitting a first control signal according to the operation signal;

a plurality of air-conditioning devices for receiving the first control signal and operating according to the first control signal; and a plurality of smart electricity meters respectively electrically coupled to the plurality of air-conditioning devices for uploading an electric power consumption and an electricity consumption history of the plurality of air-conditioning devices to the Internet, wherein the application program accesses the electric power consumption and the electricity consumption history of the plurality of air-conditioning devices via the Internet, wherein the application program further accesses an electricity price and a contract capacity via the Internet, wherein when the electric power consumption of the plurality of air-conditioning devices exceeds the contract capacity, the application program displays a warning message while controlling the operation of the plurality of air-conditioning devices, wherein the application program further transmits a second control signal according to the electricity price through the air-conditioning controller to control an operation mode of the plurality of air-conditioning devices, wherein the application program further transmits a third control signal according to the contract capacity through the air-conditioning controller, so that when the electric power consumption of the plurality of air-conditioning devices exceeds the contract capacity, the application program controls and stops the operation of the plurality of air-conditioning devices through the air-conditioning controller, and wherein the application program calculates the electricity price, the contract capacity and the environment temperature by a fuzzy logic algorithm to transmit the first control signal, the second control signal and the third control signal through the air-conditioning controller.

2. The air-conditioning system integrated with the application program of the smart portable device according to claim 1, wherein the air-conditioning controller transmits the temperature signal and receives the operation signal by a Bluetooth, Zigbee, Radio Frequency (RF), Wireless Fidelity (Wi-Fi), (Worldwide Interoperability for Microwave Access (WiMAX), General Packet Radio Service (GPRS), 3rd Generation (3G) telecommunications technology, 3.5th Generation (3.5G) telecommunications technology or Long Term Evolution (LTE) technology.

3. The air-conditioning system integrated with the application program of the smart portable device according to claim 1, wherein the air-conditioning controller transmits the first control signal by an omni-directional infrared technology.

4. The air-conditioning system integrated with the application program of the smart portable device according to claim 1, wherein when the environment temperature deviates from a predetermined temperature set by the application program, the air-conditioning controller controls the plurality of air-conditioning devices to operate, stop or adjust an operation mode for adjusting the environment temperature to the predetermined temperature, wherein the predetermined temperature is corresponsive to different time intervals, and the application program further adjusts the environment temperature in the time intervals to the predetermined temperature according to the predetermined temperature in the time intervals.

* * * * *